United States Patent [19]

Ito et al.

[11] 4,030,534

[45] June 21, 1977

[54] APPARATUS FOR CONTINUOUS CASTING USING LINEAR MAGNETIC FIELD FOR CORE AGITATION

[75] Inventors: Yasuo Ito; Yoshitake Suzuki, both of Kisarazu, Japan

[73] Assignee: Nippon Steel Corporation, Tokyo, Japan

[22] Filed: Jan. 14, 1976

[21] Appl. No.: 649,019

Related U.S. Application Data

[62] Division of Ser. No. 431,605, Jan. 8, 1974, Pat. No. 3,952,791.

[30] Foreign Application Priority Data

Apr. 18, 1973 Japan ..... 48-46371

[52] U.S. Cl. ..... 164/147; 164/250; 164/282

[51] Int. Cl.² ..... B22D 11/12

[58] Field of Search ..... 164/49, 82, 250, 273 R, 164/282, 147

[56] References Cited

UNITED STATES PATENTS

| | | | |
|---|---|---|---|
| 2,877,525 | 3/1959 | Schaaber | 164/82 X |
| 2,963,758 | 12/1960 | Pestel et al. | 164/49 X |
| 3,605,865 | 9/1971 | Getselev | 164/147 UX |
| 3,656,537 | 4/1972 | Von Starck | 164/82 X |
| 3,693,697 | 9/1972 | Tzavaras | 164/147 X |
| 3,882,923 | 5/1975 | Alberny et al. | 164/282 X |
| 3,905,417 | 9/1975 | Delassus | 164/250 X |

FOREIGN PATENTS OR APPLICATIONS

| | | |
|---|---|---|
| 206,103 | 6/1955 | Australia |

*Primary Examiner*—Ronald J. Shore
*Attorney, Agent, or Firm*—Wenderoth, Lind & Ponack

[57] ABSTRACT

A continuous casting apparatus having a mold, a device for withdrawing the cast object from the mold object for sopporting the cast object during withdrawal, an electromagnetic agitator at a position along the path of the withdrawn cast object opposite the crater of molten metal within the cast object, and a plurality of rolls of non-magnetic material in the vicinity of the electromagnetic agitator for supporting the cast object being withdrawn from the mold. The electromagnetic agitator has a core on opposite sides of the path of the cast object having a plurality of deep slots therein facing the cast object, coils wound around the cores at the bottoms of the deep slots, and a housing of non-magnetic material over the cores on opposite sides of the path of the cast object. The housing for the cores has a head over the portions of the cores between the slots and tapering toward the path of the cast object, the housing protecting the core and the coils.

4 Claims, 36 Drawing Figures

APPARATUS FOR CONTINUOUS CASTING USING LINEAR MAGNETIC FIELD FOR CORE AGITATION

The application is a Division of our copending U.S. patent application Ser. No. 431,605 filed Jan. 8, 1974 now U.S. Pat. No. 3,952,791.

BACKGROUND OF THE INVENTION

The present invention relates to an apparatus for continuously casting molten metal, particularly an apparatus for continuously producing a cast object having an improved quality by agitating with electromagnetic induction during the continuous casting.

It is usual for very many kinds of molten metals to contain a variety of foreign elements, for example carbon, silicon, manganese, phosphorus, sulfur, aluminum, nickel, chromium, etc. It is known that in the process of cooling a cast object contaning such elements as mentioned above to solidify it, as solidification progresses these elements concentrate in the center of the cast object so as to crystallize into simple substances or compounds. Thus, the part of the cast object that solidifies last may contain such elements in a greater amount than the other parts which have solidified earlier. Therefore, said part may solidify at the lowest temperature, and is known by the name "segregation part ".

Products made of the casting containing the segregation part tend to have a lowered and/or nonuniformly distributed mechanical strength, possible causing troubles at the time of welding, so that they have a low commercial value. In order to prevent such troubles, there has been devised in the case of traditional casting using a closed-end mold a raised rate of feed so that the increased feed will contain the segregation part which can be cut away afterward. However, such a method results in a lowered production yield and an increased production cost, constituting a disadvantage thereof. In the case of a continuous casting method, segregation takes place in the direction perpendicular to that of withdrawing the cast object to so great an extent that no good devices or operation conditions are available to reduce, without difficulty, the size of the segregation part below the level achieved in the case of using the abovementioned way of casting by using the closed-end mold.

In efforts to solve such problems as the lowered productioon yield in the case of casting by using the closed end mold and the nonuniform distrubution of quality of the casting made by the continuous casting method, there has been recognized the necessity of a molten metal cooling process which works sufficiently to halt the segregation of the elements contained in the molten metal for obtaining a uniform distribution thereof. There is known such a method of agitating the crater of the cast object by using an electromagnetic force. However, this method has not yet been industrialized, as there has not yet been developed the optimum agitating force and flow pattern thereof according to kinds of molten metals, even though it is considered to be the most stable among various methods.

It is confirmed that in the cast object solidifying process using the conventional electromagnetic agitation method, dendrite is broken up, but a heavier agitation for further breaking of the dendrite will cause the formation of the so-called "white band "on the border between the dendrite and the free crystal. In the case of the cast slab, the white band tends to be thick along the short side which the flow of agitated molten metal hits.

As for the white band, there has been no one investigate it, much less do research into its composition in relation to the quality of the cast object. So far as the inventors of the present invention have confirmed, the white band is a kind of negative segregation, the content of which is less concentrated than that of the other part, proving that such a cast object is not qualified as commercial material; and, the white band itself spoils the good appearance of a product made of such a cast object.

In whichever direction agitation occurs, it is unavoidable that the white band will be formed so long as the molten metal flows. According to the experiments conducted by the inventors of the present invention, it has been found to be impossible to prevent formation of the white band by modifications of the electromagnetic agitation applied to the object cast duriing continuous casting. Agitation according to the known method for preventing the formation of the white band fails to reduce the amount of dendrite, resulting in a failure also of the original purpose of the agitation.

As for the electromagnetic agitator for use with the continuous casting apparatus, its main body is heated to a high temperature during operation by radiant heat from the cast object and heat generated from current running in the coils. As a result, its frame deforms, making it difficult to supply current to the coils throughout a long continuous operation and also to reduce the gap between the cast object and the agitator to a minimum, causing such troubles as a serious loss of electromagnetic energy, a shorter life of the coils and flaws on the surface of the product.

In order to get rid of these problems, there has been used a device to cool the electromagnetic agitator with an appropriate coolant. Thus, the agitator has its main body cooled near or to room temperature for some time from the start of operation or at the time of repairs, and then it is heated, thus being subjected to cycles of heating and cooling. In such case, where a water cooling system, which is the most economical for this purpose, is used, water drops stay on the inside wall of the frame and the surface of the coils, causing such troubles as: (a) the interruption of current supply or limitation of applied voltage due to the degradation of the insulation on the coils; and (b) the production of rust on the parts of the agitator due to the high temperature inside the frame. The integration of current supply to the coils causes an integration in the operation of the electromagnetic agitator; and the production of rust necessitates extensive maintenance of the agitator. The part of the continuous casting apparatus on which the main body of the electromagnetic agitator is mounted is in a narrow place subjected to dust deposit and high temperature, such position making almost impossible daily inspection and maintenance in spite of the necessity thereof.

Such agitator is provided usually at an appropriate position away from the surface of the molten metal in the mold in the direction of withdrawing the cast object. In order to prevent such troubles in the operation as the formation of cracks inside the cast object or break-out (of molten out of the solidified shell), it is necessary to provide the agitator without changing the pitch of the cast object supporting guide rolls, a great number of which are provided in the direction of withdrawing the cast object in the continuous casting apparatus.

SUMMARY OF THE INVENTION

An object of the present invention is to provide a continuous casting apparatus for producing a cast object containing a small segregation part by halting the growth of the dendrite by the agitation of the molten metal during the solidification process by means of electromagnetic induction.

A further object of the present invention is to provide a continuous casting apparatus for effectively carrying out continuous casting equipped with an electromagnetic agitator which can be inspected and maintained with ease and at low cost and which will operate at low running cost without spoiling the sanitary working conditions.

A still further object of the present invention is to provide a continuous casting apparatus in which the distance between supports for the cast object can be made as small as permissible and which also produces efficient electromagnetic agitation with very small energy loss.

A still further object of the present invention is to provide continuously cast steel slab having excellent quality and which has a layer of equiaxed crystal of uniform thickness symmetrically against the central-in-thickness part of the slab in the core part thereof.

The abovementioned and other object of the present invention will become more apparent by reference to the following detailed explanation and embodiments.

In order to achieve the abovementioned objects, the continuous casting according to the present invention is characterized by the presence of a velocity vector of the main flow the agitated molten metal in a plane perpendicular to the direction of withdrawing the cast object, and by electromagnetic agitation of the molten metal during the process of solidification which is carried out so that the main flow of the crater of the cast object will be confined within a limited agitation zone.

Likewise, the continuous casting apparatus of the present invention is characterized by having means for withdrawing the cast object equipped with a group of rolls made of a non-magnetic material in the vicinity of the electromagnetic agitator, and by having an electromagnetic agitator consisting of a core having deep slots, coils wound around the core, and a housing made of a non-magnetic material which is tapered to its head for protecting the core and the coils.

BRIEF DESCRIPTION OF THE DRAWINGS

FIGS. 14*a*–14*c* are graphs showing the relationship between the velocity delay and the current direction alternation time, of which:

FIG. 14*a* shows the case where the current direction alternation time is longer than the velocity delay;

FIG. 14*b* shows the case where they are equal; and

FIG. 14*c* shows the case where the current direction alternation time is shorter than the velocity delay;

DESCRIPTION OF THE PREFERRED EMBODIMENT

Figure 1:
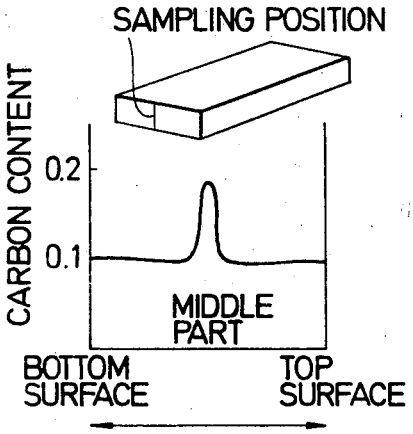
PRIOR ART FIG. 1
FIGS. 1 and 2 are graphs showing the distribution of carbon content of a typical continuously cast slab.

In a continuous casting method, the heat transmission in the direction perpendicular to the direction of withdrawing the cast object is far greater than that in the direction of withdrawing the cast object, so that such segregation as mentioned above comes about in the thickness direction of the cast object. FIG. 1 is a typical graph showing the distribution of carbon content at various points in the thickness direction of a continuously cast slab of normal carbon steel.

Figure 2:
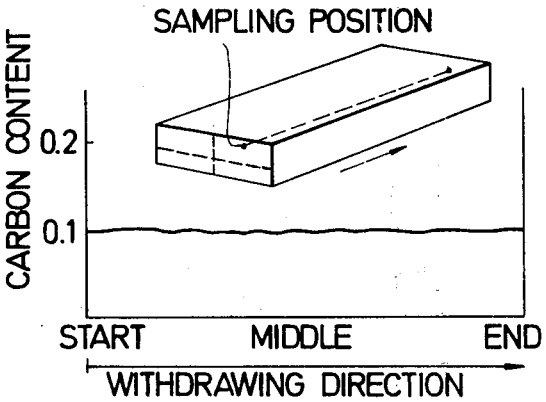
PRIOR ART FIG. 2

In the drawing, there is shown the positions at which the sampling for analysis was made. As is easily understandable from this graph, the carbon content in the center of the thickness of the slab, that is, the part in which the crater of molten steel may exist to the last, is 0.18%. This value is considerably higher than 0.10%, which is the value at the other positions. On the other hand, FIG. 2 shows that the carbon content remains the same in the direction of withdrawing the cast object.

While the following explanation of the present invention is made for the case in which molten steel is the metal containing a variety of elements, it will be understood that the apparatus of the present invention is applicable to any other kinds of molten metal. As for the determination of the size of the segregation part of the cast steel object, it is conducted very rarely by the analysis of constituents, but generally in such a simple way as the classification of sensed data. In the following description, segregation is evaluated according to the classification of sulfur prints.

Figure 3:
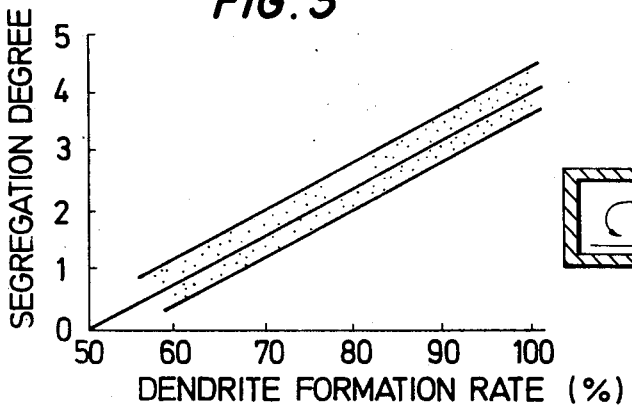
FIG. 3 is a graph showing the relationship between the degree of segregation and the dendrite formation rate.

When segregation is viewed from the standpoint of the solidification structure, it is concluded that if dendrite increases and the equiaxed zone contracts, segregation will become very great. FIG. 3 shows the relationship between the degree of segregation and the percentage of the area which is dendrite in a plane perpendicular to the direction of withdrawing the cast object (hereinafter called the "C plane "). The amounts of segregation in this graph were determined according to the evaluations of the size and shape (whether the segregation part is spread or spotted) in the center of the sample cast object on sulfur prints, thus showing the ratio of the area in which dendrite is formed to the total area. As is understandable from FIG. 3, the degree of segregation is related linearly to the percentage of the area which is dendrite.

If the casting having a large dendrite zone is rolled into rolled products, troubles will take place due to the presence of such a segregation part during welding of thick plate rolled from the casting, and in the form of minute waving, such as ridging, which occurs in stainless steel in thin sheet form. Such defects arising from the segregation consisting mainly of dendrite are known, and operation conditions have been studied in an attempt to prevent such defects. Moreover, in the case of continuous casting, it is possible that in the cast object during the process of solidification, there is formed a temperature gradient because of the solidification speed being raised by forced cooling by using sprays of coolant, which gradient causes the growth of dendrite. Therefore, it is very difficult to halt the growth of dendrite only through control of operation conditions.

As one series of methods for halting the growth of dendrite, there has been proposed a variety of methods of breaking up dendrite by using external force. Among these methods, the most widely used one uses electromagnetic force. It is the so-called electromagnetic agitation method.

This method has been presented in a variety of modifications. These modifications are classified by patterns of flow of the agitated molten metals, so that it may be said that the pattern of such flows is a basic factor of electromagnetic agitation common to all the modifications of the method. People have been making efforts to achieve agitation in a pattern which is desirable for their purposes.

Figure 4:
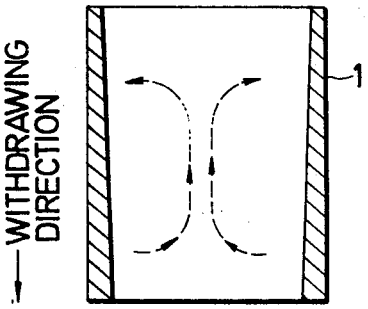
FIGS. 4 and 5 are explanatory diagrams of the pattern of respective agitation flows.
Figure 5:
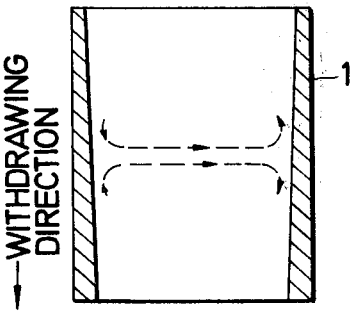

Such patterns of flows of the agitated molten metal are roughly classified into two groups. One group consists of such patterns as shown in FIG. 4, in which the velocity vector of the main flow of the agitated molten metal is parallel with the direction of withdrawing the cast object (hereinafter called L-plane agitation), and the other group consists of such patterns as shown in FIG. 5, in which the velocity vector of the main flow of the agitated molten metal is perpendicular to the direction of withdrawing the cast object (hereinafter called C-plane agitation). These two kinds of agitation are worked out to achieve the uniformly distributed solidification structure by breaking up dendrite which has grown during the process of solidification of the molten metal.

The inventors of the present invention conducted experiments using water-tank tests and tests on the molten flows of metals having low melting points, and further study of the known agitation methods, in order to find out the influences that various patterns have on the solidified structure. The result of their conducted experiments is as follows.

Figure 6:
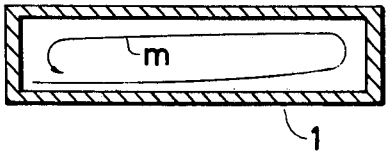
FIGS. 6 and 7 are explanatory diagrams of respective flows of the agitated molten metal in the C-plane agitation.
Figure 7:
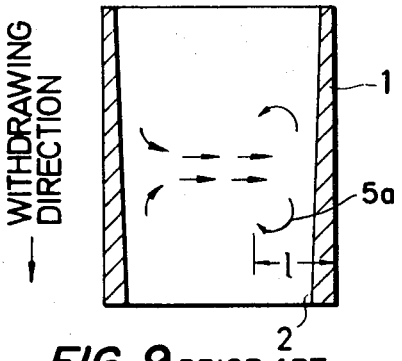
Figure 9:
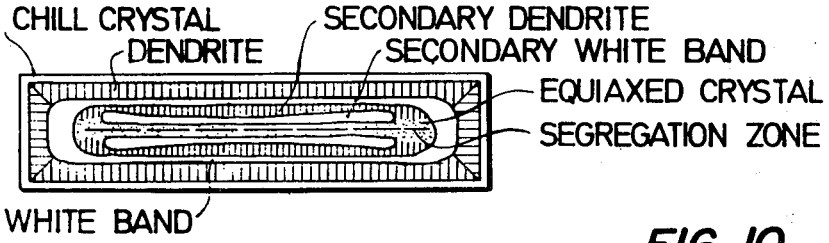
FIG. 9 PRIOR ART
FIG. 9 is a schematic reproduction of a sulfur print of the cross-section of a slab continuously cast and agitated by a conventional electromagnetic agitation method.

In the case of C-plane agitation, the agitation for a cast slab having the ratio of width of height which is comparatively great, say, more than 3, in a fixed direction, and more particularly such agitation that the velocity vector of the main flow of the agitated molten metal of the cast slab is present in a plane perpendicular to the direction of withdrawing the cast slab, produces a secondary dendrite or such secondary white zone as shown in FIG. 9 (hereinafter the white band of greater breadth is also called a white zone for convenience) in the C-plane, preventing the whole agitation zone from turning to equiaxed crystal. If the ratio is more than 3, it will become difficult to obtain circulating flow ($m$) on the C plane, such as shown in FIG. 6, because the flow of the agitated molten metal will be limited in the direction parallel to the width direction of the cast slab, and because the flow of the agitated molten metal which has hit the solidified shell 1 on the short side of the cast slab is diverged and turns downward and upward, as shown in FIG. 7. In order to prevent the formation of such flow, the alternate reversing of flowing directions at intervals may be somewhat effective, but it is difficult for such a method to prevent by itself the formation of the segregation zone as shown in FIG. 9. In the case of a cast bloom, a cast billet or the like having the abovementioned ratio which is nearly 1.0, it is possible to achieve the uniformly distrubuted solidification structure of the stable agitation obtainable by operation in one fixed direction, as well as by the alternate reversing of the flowing direcion at intervals.

In the case of L-plane agitation, it is possible to achieve a fairly uniformly distributed agitation even where the cast slab has a greater width-to-height ratio compared with the agitation in the case of the C-plane agitation. Therefore, it is easier to prevent the formation of the white zone as described above by L-plane agitation. However, this agitation has a disadvantage that the temperature distribution of the flow of the agitated molten metal becomes nonuniform by its mixing with the flow of the molten metal just poured into the mold, particulary with the flow of the molten metal poured from an immersed nozzle which has recently been used increasingly for the continuous casting method. Therefore, the L-plane agitation must be carried out at such a position that is free from the influence of the abovementioned flows, particularly that of the molten metal poured from an immersed nozzle. Moreover a continuous casting apparatus of a commercial type has a great number of rolls in the direction of withdrawing the cast object to support it as it is running out from the mold. It is impossible for the present technology to arrange electromagnetic coils which provide a reliable supply of a stable electromagnetic force without irregularities in the arrangement of such rolls at the positions suited for their function.

As described above, the secondary white zone forms as a result of upward turn of the flow which diverges from the main flow of the agitated molten metal hitting the solidified shell. If the upward flow becomes greater, thus making the distance l shown in FIG. 7 greater, the secondary white zone becomes greater. In order to prevent the formation of the secondary white zone, the upward flowshould flow should made to pass through a narrow space along the inside 2 of the solidified shell, where the white zone occurs. That is to say, the flow should be controlled so that, in FIG. 7, distance l is shortened, causing the downward flow formed near the solidified wall along the short side of the cast object to turn sharply back toward the other edge of the casting and turn further and become an upward flow right near the diverging point (hitting point) of the hitting flow (see arrow *5a*,FIG. 7). as a result, however, the white zone will become somewhat greater, but it is easy control the size so as not to degrade the quality of the cast object.

As for the process of formation of the secondary dendrite, it is considered that the reason for formation of this material is that the secondry dendrite, which is considered to be an extension of the original dendrite, in the shape of a long pillar bunched with a cord in its middle part, will form easily when there is only a small agitation force. The local agitation force can be very small where the molten metal moves as a whole, but every part thereof does not change its position in relation to the other part, making the agitiation ineffective and hence permitting the formation of the secondary dendrite.

On the other hand, when the agitation force is not correct, the original type of the secondary dendrite is replaced by another type of secondary dendrite, that is, some form of secondary dendrite continues to exist. This is a very important point, which the present invention is founded on. That is to say, as shown in FIG. 7, the flow of the agitated molten metal is branched into an upward flow and a downward flow as a result of hitting the solidified surface. The molten metal in the upward flow flows into molten metal of a comparatively high temperature, and such high temperature molten metal flows down into the main flow of the agitated molten steel flowing in the C-plane. There will not be complete equalization of temperature between the molten metal in the main flow in the C-plane along the side edges from which heat is being transferred to the solidified metal and the flow having a comparatively high temperature coming down into the main flow in the C-plane. There will be a temperature gradient from the center toward the edges of the main flow which works for the growth of dendrite. Regarding the downward flow branched from the flow hitting the solidified shell, as a result of the agitation, it is not so influential as the upward flow, but is naturally a problem if it is of so great a volume as to influence the upward flow.

The purpose of the present invention is to obtain a uniform distribution of the solidification structure which is free from the second white zone and also from the secondary dendrite, both of which may form due to the upward flow and the downward flow branched from the main flow of the molten metal agitated in the C-plane during agitation of the cast object, such branching having been caused by hitting of said main flow against the solidification surface (that is, the inside 2 of the solidified shell). For this purpose, the velocity vector of the main flow of the agitated molten metal should be within the C-plane, and agitation should be so carried out that the whole of the agitated molten metal will flow within the agitation zone.

Figure 8:
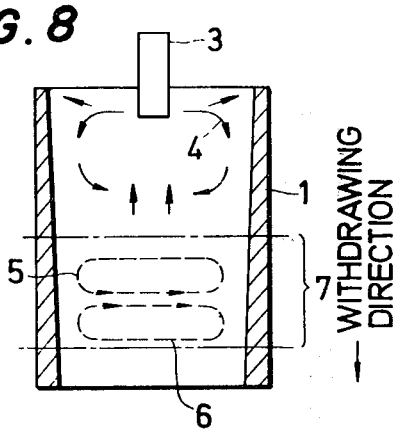
FIG. 8 is an explanatory diagram of the method of the present invention.

More specifically, the velocity of the main flow 5 of the agitated molten metal should be made greater, say more than ten times greater, than the velocity of the flow 4 of the molten metal poured from the immersed nozzle 3, as shown in FIG. 8, thereby making the turbulence of the agitated flow due to the flow 4 negligible. A value of "more than 10 times" is easily attainable in view of the fact that an agitation velocity of 2 m/second is within the capacity of an agitator of the normal type, and the pouring velocity from the nozzle can be set to any value by selecting a proper nozzle from a variety of shapes of nozzles, the velocity from nearly all the ordinary types of the apparatus for continuously casting slabs of large size being less than 0.1m/second. Moreover, since the velocity of withdrawing the cast object is between 1/30 and 1/80 of the abovementioned, it may be concluded that the velocity vector of the main flow 5 of the agitataed molten metal is substantially in the C-plane.

Further, the velocity of the main flow 5 of the agitated molten metal should be so limited that the flow of the agitated molten metal does not extend bey9ond the agitation zone 7 which extends over an appropriate distance in the direction of withdrawing the cast object. The size of the agitation zone 7 is determined according to the width of the white zone which is allowable for the object being cast, and the velocity of the main flow 5 of the agitated molten metal is so determined that the flow of the agitated molten metal is confined within the agitation zone 7. The restriction of the presence of the flow of the agitated molten to within the agitation zone 7 is an indispensable condition to prevent the formation of the secondary dendrite due to possible irregular distribution of the temperature within the crater. In the case of a liquid such as water that has a very low viscosity, a high velocity of the main flow will make the flow 6, shown in FIG. 8 by the dotted lines, form a loop, therefore making it difficult to make the agitation zone 7 narrow. However, in the case of a molten metal such as molten steel, this has a high viscosity so that it is comparatively easy to make the agitation zone 7 narrow. Also, in order to make possible uniform agitation in the agitation zone 7, a part that is not subjected to flowing by agitation, that is a dead zone, should be formed.

Another matter to be considered is the distance from the mold to the position where such agitation should be carried out. For this matter there should be taken into consideration the kind of molten metal, the capacity of the agitator, the mechanism of the continuous casting apparatus, and the like. Generally speaking, in order to obtain a small amount of dendrite, agitation should be done at the position where the solidified shell is as thin as possible, as described above, to raise the velocity of the main flow of the agitated molten metal, thereby lessening the influence of the flow of molten metal being poured, so that it is possible to carry out agitation very near the mold.

The following is the gist of the present invention explained with reference to a specific embodiment:

The sample cast object: A cast slab 210mm thick and 2050 mm wide 41EK grade thick plate for ship steel.

Composition: 0.15% C, 0.80% Mn, 0.2% Si.

Type of continuous casting apparatus: 10.5 R low head type.

Travelling electromagnetic field generator frequency of current source: 8 Hz.

Figure 10:
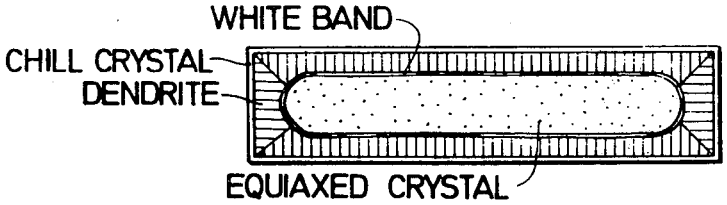
FIG. 10 is a similar reproduction of a sulfur-print of the cross-section of a slab continuously cast by the method of the present invention.

While using an apparatus with the abovementioned specifications, the size of the aitation zone extended about 300mm with the travelling electromagnetic field generator at the center of such zone. The generator was positioned at two positions which were, respectively, 5 meters from the mold and just below the mold. These two positions were used for comparison between the influence at the respective positions of the flow of the molten steel poured from the immersed nozzle. As for the direction of the main flow of the agitated molten steel during the process of agitation, there are available two kinds of agitation in terms of direction; that is, an agitation mode intermittently in one fixed direction and agitation in two opposite directions alternated at intervals. In the C-plane agitaton for the abovementioned experiment, the former kind of agitation was not used, as it was difficult for the abovementioned apparatus to make the flow of the agitated molten steel form loops. As for the results of the experiments, differences were caused by a variety of patterns of current supply from the travelling electromagnetic field generator. When the pattern was good, the experiment was successful in obtaining a slab having a uniform solidified structure without formation of either a secondary white zone or secondary dendrite. FIG. 10 is a sulfur print of one example of the so obtained slab. The difference in the position at which the travelling electromagnetic field generator was mounted resulted only in a difference in the length of the crystals of dendrite.

The following is the result obtained from the studies of the electromagnetic agitation method which is capable of halting the formation of the white band, as well as decreasing the segregation part of the cast object during the process of solidification through the decrease of the dendrite area therein, such studies being made with the emphasis placed on the possibility of controlling the energy source for causing the flow of the agitated molten steel.

Figure 11:
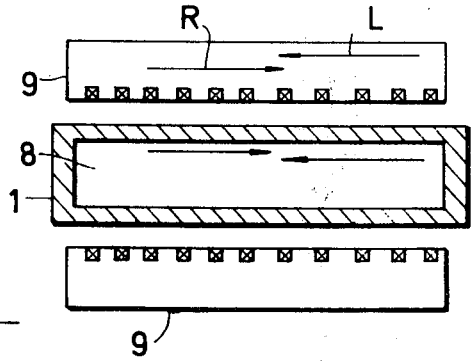
FIG 11 is a sectional schematic view showing an embodiment of an apparatus for applying electromagnetic agitation to the object cast by the continuous casting method of the present invention.

In FIG. 11, which shows an embodiment of the apparatus of the present invention in which the method was applied to the crater of the cast object (for example, a cast slab) cast by a continuous casting method, numeral 1 indicates the solidified shell of the cast object, numeral 8 indicates the crater of the cast object, and numeral 9 indicates an electromagnetic agitator positioned along the long side of the cast object. Said electromagnetic agitator 9 is one in which the polyphase alternating current is supplied to polyphase winding coils wound around an iron core to generate a travelling electromagnetic field moving in a specified direction (in the width direction of the cast slab in the drawing), thereby causing the flow of the agitated molten metal in a direction perpendicular to the direction of withdrawing the cast object, i.e. in the C-plane. Naturally, the electromagnetic agitator 9 may be so arranged as to cause the flow in the same direction of the withdrawing of the cast object. As for the mounting position of said agitator 9, it may be mounted at any appropriate position between just below the mold and the end point of solidification of the cast object.

According to the present invention, the supply of current to the electromagnetic agitator 9 of the abovementioned apparatus is of a current which is in one direction (hereafter called the "positive direction") and then is changed to the opposite direction, the current in the positive direction being such as to generate a travelling electromagnetic field in the directon R in FIG. 11, and when changed over to the reverse direction to generate the traveling electromagnetic field in the direction L opposite to the above direction.

For narrowing the agitation zone 7, it has been found to be very effective to turn the area near the short side of the solidified shell 1 against which the total flow in the crater 8 hits into a zone of inertia flow in the flow produced by electromagnetic agitation by causing said total flow in the crater 8 to hit the short side of the cross-section of the cast object as gently as possible; in other words, to cause the molten metal in the crater 8 flowing toward the short side of the cast object driven by thrust caused by electromagnetic force, to continue flowing on inertia after the driving electromagnetic force has been discontinued, so that the thus containing flow will hit the short side of the solidified shell 1 gently.

Figure 25:
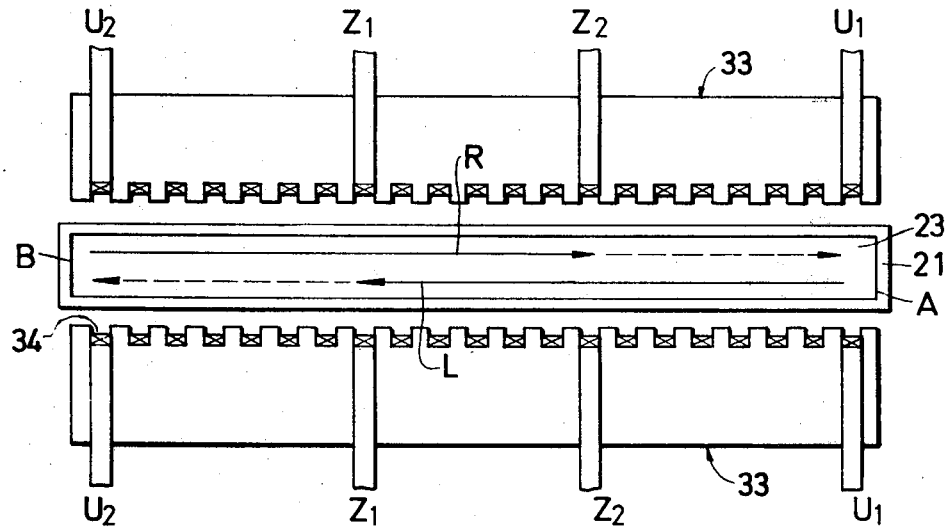
FIG. 25 is a sketch showing the current supply system to coils of the electromagnetic agitator.

Referring to FIG. 25, the excitement of the coils in the direction $U_2$ to $Z_2$ produces thrust in the direction R shown with a full line for making the molten steel flow. At that time, however, the coils between $Z_2$ and $U_1$ are not excited, so that the molten steel flows by inertia in the direction R from coil $Z_2$ toward coil $U_1$ (shown with a dotted line), and hits the area A on the short side of the cast slab gently.

Such gentle hitting of the molten steel against the area A or B on the short side of the cast slab means that the impact does not cause wide divergence of the main flow of the agitated molten steel in the directions upward and downward, and therefore such gentle hitting makes it possible to confine the agitation of the molten steel within the limited area, so that almost no white band is produced around the areas A and B, resulting in good quality of the slab.

In other words, when circulating the molten steel by exciting the upper electromagnetic agitator in the direction $U_2$ to $Z_2$ and the lower electromagnetic agitator in the direction $U_1$ to $Z_2$, referring to FIG. 25, this arrangement of coils as described above makes it possible to agitate the molten steel within the limited area, without the danger of a strong impact of the molten steel in the areas A and B, thereby reducing the wide divergence of the main flow of the agitated molten steel.

Also in FIG. 25, $U_1$, $U_2$, $Z_1$ and $Z_2$, respectively, are one-phase portions of three-phase coils, and three-phase alternating current is actually used for the electromagnetic agitator. As for the arrangement of coils when using three-phase alternating current, this is explained in FIG. 17, and no description thereof is given with respect to FIG. 25.

Figure 29:
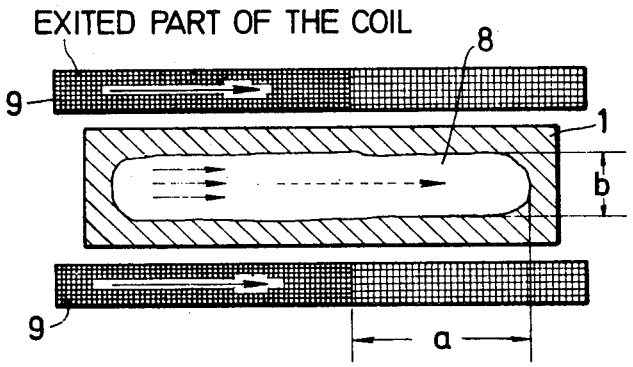
FIGS. 29 and 30 are, respectively, schematic diagrams of the flow of molten metal in respective slabs.
Figure 30:
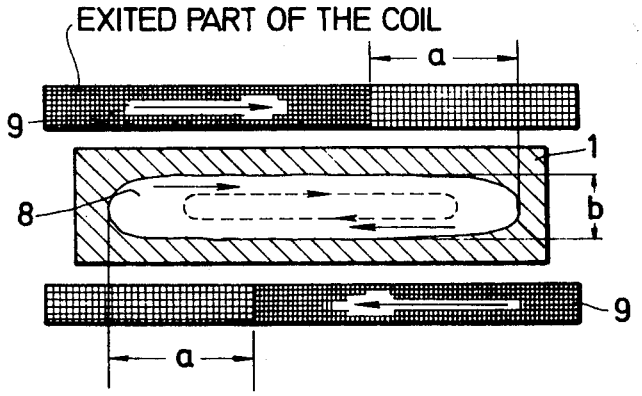

By the method described above, the molten metal of the crater can be made to flow straight, as shown in FIG. 29, or elliptically, as shown in FIG. 30. It is desirable to give to the molten metal in the crater sufficient thrust to make the flow of the molten metal, in the case where the course of the flow of the molten metal forms an ellipse, according to the formula $a \geq b \times 3$, wherein $a$ represents the length of the inertia flow zone; $b$ represents the thickness of the crater in the inertia flow zone; and according to the formula $a \geq b \times 10$ in the case where the course of the flow is in a straight line.

The reason for making the ratio between the length of the inertia flow zone ($a$) and the thickness of the crater $b$ more than 3 is that a value lower than the abovementioned is not helpful in eliminating the segregation, creating the danger of abnormally partially reducing the tensile strength of the thick plate eventually produced from the casting.

However, the upper limit of the ratio between the length of the inertia flow zone ($a$) and the thickness of the crater $b$ is not specified, as it changes with an improvement of the performance of the electromagnetic agitator. If the ratio is so great that the agitation force becomes small because of the equipment, an effect nearly as great as is obtainable with the ratio as described above can be obtained by the use of a plurality of electromagnetic agitators spaced in the direction of drawing of the slab, or by shortening $a$ and also by increasing the thrust by switching over the direction of the exciting coils frequently. However, this is not the best method because of difficult maintenance.

When using a plurality of electromagnetic agitators in the direction of drawing of the cast object, the uppermost one, that is, the one placed closest to the mold, should be used for giving such thrust as described above to the molten metal.

In the continuous casting of steel slab, steel slab of good quality can be produced, which has a layer of equiaxed crystal of uniform thickness symmetrically in the center of the thickness of the slab, by moving the molten steel in the width direction of the slab in a plane perpendicular to the direction of drawing the cast object by electromagnetic agitation energy, and by controlling the flowing speed of the molten steel before the molten steel hits the solidified shell on the short side of the slab. At that time, the difference between the temperature of the molten steel right before it is poured into the mold and that on the liquidus line of the molten steel is preferably less than 100° C.

Figure 12:
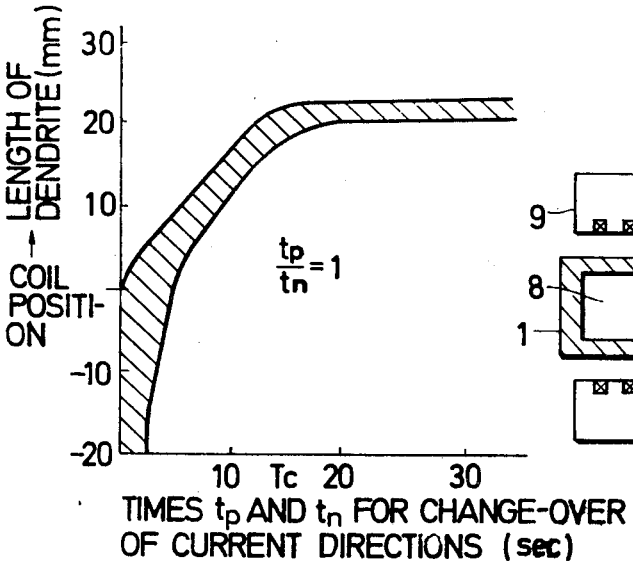
FIG. 12 is a graph showing the relationship between the length of dendrite and the time for respective current directions used alternately for the electromagnetic agitator in the process of soldification of molten steel according to the present invention.

FIG. 12 shows the result of experiments made by the inventors of the present invention as to the change in length of dendrite in the solidified structure of the cast object, which change takes place on the changeover of the current supply direction between the positive direction and the reverse direction in terms of the time of current supply in the respective directions. In the drawing, $tp$ means the time for current supply in the positive direction; $tn$ means the time for current supply in the reverse direction. The horizontal axis is for the length of time (second) of each type of current, so that, where $t_p = t_n$, 20 seconds, for example, means tp 20 seconds and then the current is changed to $tn$ for 20 seconds. It can be understood from FIG. 12 that an increase of the time of current flow causes the phenomenon of remelting of the crystal due to the flow of the agitated molten steel, breaking up the dendrite into a shorter length up to a certain length of time of current flow, after which point there is almost no change of the length of dendrite. Such point is taken as the critical point T$c$. According to the knowledge and experience of the inventors of the present invention, the critical point T$c$ has nothing to do with input, and changes under the influence of viscosity of various kinds of steel.

Figure 13:
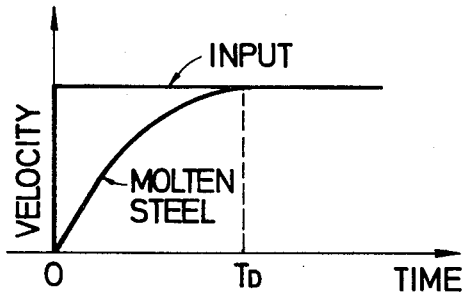
FIG. 13 is a graph showing the delay of the velocity of molten steel flow due to its viscosity.

In this connection, reference is made to FIG. 13 showing schematically the rate of increase of the velocity of molten steel flow due to its viscosity. This shows that even if the prescribed velocity is achieved stepwise, normal molten steel requires an acceleration time T$d$ before reaching the desired input velocity, because of the resistance due to viscosity. This acceleration time T$d$ may be the same as T$c$ in FIG. 12. With some allowance for differences in the kinds of steel, input and the other factors, T$c$ should be in the range from 5 to 30 seconds.

Figure 14A:
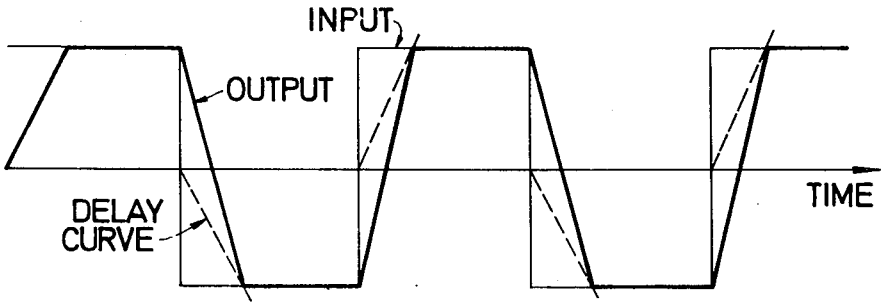
Figure 14B:
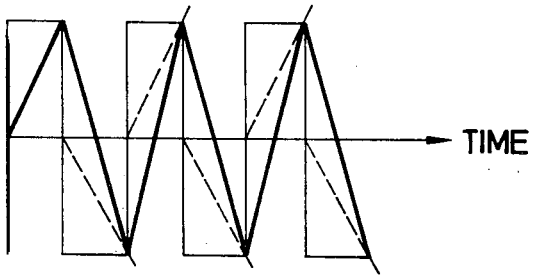
Figure 14C:
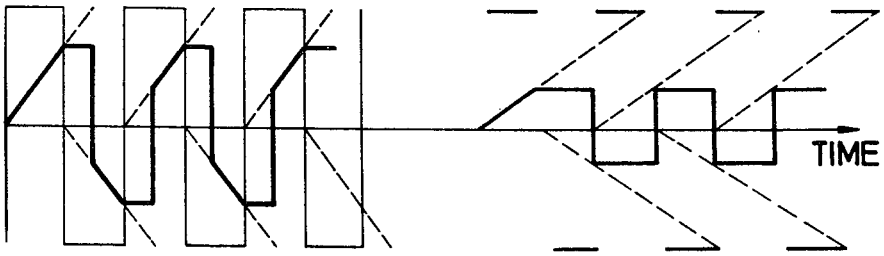

The following is an explanation of the relation between the duration of current flow in alternate directions and the acceleration time of molten steel flow in reference to FIGS. 14$a$–14$c$. FIG. 14$a$ shows the case where the duration of current flow is longer than the acceleration time of molten steel flow, FIG. 14$b$ indicates the case where the duration is equal to the acceleration time of molten steel flow, and FIG. 14$c$ indicates the case where the duration is shorter than the acceleration time of molten steel flow. In FIG. 14$a$, because of the length of time for which the flow of the agitated molten steel (shown as a horizontal line in the drawing) runs in the fixed direction, there is a possibility of formation of the white band. In FIG. 14$c$, because current direction is changed over before the velocity of the molten steel reaches that which should be achieved by the input, there can be obtained no effect of break up of the dendrite which is the purpose of the agitation. Referring to FIG. 12, if the duration of current flow is substantially longer than T$c$, such as is the case for FIG. 14$a$, dendrite will be broken up, but the white band will not be suppressed, but secondary dendrite cannot be avoided, because of the small amount of input current.

On the other hand, in the case of FIG. 14$b$, the molten steel receives a thrust in the reverse direction just at the time its velocity has reached the prescribed level, so that it receives great agitation force, while there is almost no movement of the molten steel itself, therefore making the agitation effective both in breaking up dendrite and in halting the formation of the white band. It is concluded from the abovementioned that the agitation method most effective for suppressing the white band and breaking up dendrite is that in which the time duration of current flow in alternate directions is made equal to the acceleration time of molten steel flow due to its viscosity; the agitation according to this method will cause a great agitation force at the time of current changeover, which is effective to break up dendrite;

and because there is almost no flow of the agitated molten steel, the white band will be greatly reduced. So far as normal carbon steel and extremely low carbon steel are concerned, 5 to 30 seconds are enough, respectively, for *tp* and *tn*.

In the abovementioned embodiment, the explanation was given on the basis of $(tp) = (tn)$, wherein *tp* represents the time current supply in the positive direction, and *tn* represents the time of current supply in the opposite direction. In the practice of the method and apparatus of the present invention, it is permissible to make $(tp) > (tn)$, that is, to make the time of current supply in the reverse direction shorter than the time of current supply in the positive direction. This is because sufficient agitation force can be obtained if the time of current supply in the reverse direction *tn* is shorter than *tp*. If this is done, a product sufficiently good to offset the adverse effect of the white band formed by a not-too-great flow of the molten steel can be obtained. However, if the time of current supply in the reverse direction *tn* is too short, the formation of the white band may become excessive, affecting the quality of the product produced from such casting, and therefore it is desirable to maintain $(tp)/(tn)$ in the range of 1.0 to 3.0. If $(tp)/(tn)$ is more than 3, a large volume of white band forms, which produces such a bad effect on the product produced from such a casting that it cannot be used. Since the gist of the present invention, therefore, is the alteration of current directions, the frequency and quality of current used by the electromagnetic agitator should be chosen according to the foregoing for effective agitation of the molten steel Such an agitator can be used for an object cast by a casting method using closed ended molds, as well as an object cast by a continuous casting method. However, when used for the latter, comparatively better results are obtained.

As described above, the agitation of the crater of molten steel according to the present invention is effective in breaking up dendrite, and also in halting the formation of the white band, greatly improving the quality of the product made from the casting.

Furthermore, the present invention is characterized by using a traveling electromagnetic field excited by polyphase alternating current having a frequency of less than 20 Hz at a position between a point 3 meters away from the surface of molten metal in the mold in the direction of withdrawing the cast object and a point at 60% of the total length of the continuous casting apparatus, for electromagnetic induction for the agitation of the molten metal in the crater of the object cast by the continuous casting method, where the total length of the continuous casting apparatus is the distance from the upper surface of the mold to the final pinch roll.

The position at which the crater of the cast object is agitated is determined by taking into consideration the agitation effect of the molten metal, break-out and the space available for the agitator.

Figure 15:
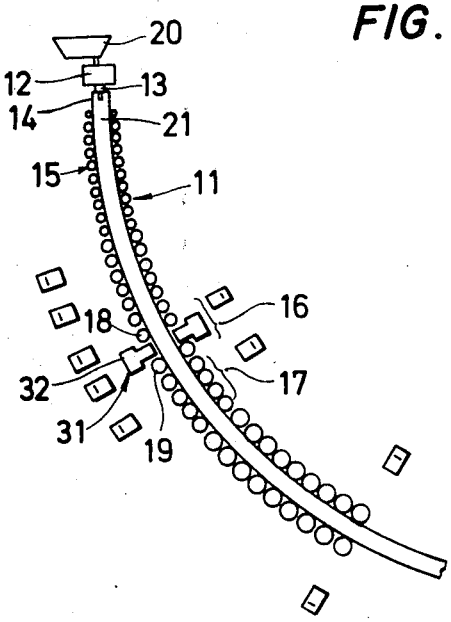
FIG. 15 is a sketch of one embodiment of the continuous casting apparatus with an agitator for the electromagnetic inductive agitation method according to the present invention.

Referring to FIG. 15, a position between the point 3 meters away from the surface of molten metal in the mold in the direction of withdrawing the cast object and the point 60% of the total length of the continuous casting apparatus is preferred to a position just below the mold as the position for agitation, because agitation at the preferred position produces an improvement of the mechanical quality of the casting. An increase of negative segregation may cause the formation of an undesirable segregation part.

Moreover, because the position for agitation must be in the range where the molten metal remains unsolidified, it should naturally be limited to a position between the surface of molten metal in the mold and the outlet of the guide roll section.

Almost all types of continuous casting apparatuses, including the L-type, are equipped with a great number of rolls in such an arrangement that very little space is provided between them. Therefore, it is necessary to take this into consideration when installing an agitator.

From the foregoing, a position between a point just below the mold and 3 meters away from it is not recommended, for such reasons as difficulty of inspection and maintenance of the apparatus and possibility of breakout, besides the formation of a negative segregation layer.

At a position beyond the point of 60% of the total length of the continuous casting apparatus from the surface of molten metal in the mold, there is no danger of breakout, but there the thickness of the solidified shell of the cast object, and the viscosity of the molten metal will increase due to a temperature drop, as a result of which the agitation effect from the electromagnetic induction will suddenly diminish. Also, as the static pressure of molten metal rises because the molten metal is well below the surface of molten metal in the mold, it will become difficult to produce electromagnetic agitation.

On the other hand, the agitation produced at a position between the point 3 meters away from the surface of molten metal in the mold and the point of 60% of the total length of the continuous casting apparatus is almost certain not to cause breakout of molten metal from the shell.

The thickness of the solidified shell is between ¼ and ⅓ of the thickness of the cast object, and there is no possibility of breakout, even though there still is an active flow of molten metal there. In this range, the temperature of the molten metal is falling and the metal has a higher viscosity than the molten metal just below the mold, resulting in a somewhat lower agitation effect which, however, can be overcome by increasing the permeability of the electromagnetic induction, the use of a more effective direction of the flow of the agitated molten metal, and some other methods.

The foregoing is the reason for the position for agitation being between the point 3 meters away from the surface of molten metal in the mold and the point 60% of the total length of the continuous casting apparatus.

If the purpose of agitation is limited to the formation of a solidified structure of the casting which is nearly all composed of equiaxed crystal uniformly distributed, the electromagnetic agitator can be positioned outside the abovementioned range, so long as it is not too far away from the range.

As described above, the viscosity of molten metal is increasing in the range, reducing the agitation effect. Such reduction, however, can be compensated for mainly by increasing the permeability of the electromagnetic induction.

The permeability of the electromagnetic force into the casting is proportionate to $1/\sqrt{\text{frequency of exciting current}}$. Therefore, the smaller the frequency of the exciting current, the greater the permeability and the resulting agitation effect.

The conventional agitation methods do not take the frequency of exciting current for the coils into consideration, nor more specifically than roughly designated less than the commercial frequency (50 Hz or 60 Hz), but such rough designation is not useful as a specification for any electromagnetic agitator.

In order to determine the frequency most effective for agitation, the inventors carried out various experiments and found that it should be less than 20 Hz. Although greater permeability of electromagnetic force can be obtained by using a low *r* frequency, the use of too low a frequency will reduce the thrust producing a flow of molten metal, and thus become impractical. Thus, the frequency should be more than 1 Hz, and preferably 4 to 15 Hz in practical cases.

The following is a description of still another embodiment of the present invention which shows its excellent casting effect.

Figure 33:
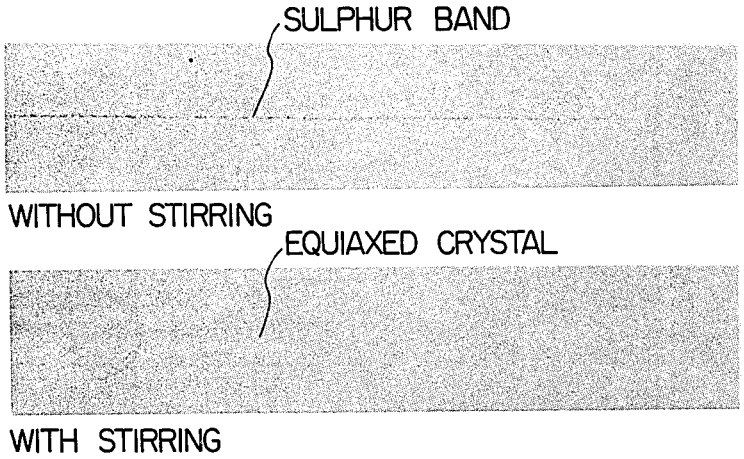
FIG. 33 is a photograph of the sulfur prints of the cross-section of the slab in a plane perpendicular to a direction of drawing the cast object, the upper part being of a steel slab continuously cast without electromagnetic agitation, and the lower part being of a steel slab cast according to the present invention.

FIG. 33 is constituted by photographs of sulfur prints off the cross-section of respective slabs in a plane perpendicular to the direction of drawing the cast object, the upper one being of a slab continuously cast without electromagnetic agitation, and the lower one being of a slab cast according to the present invention.

Figure 34:
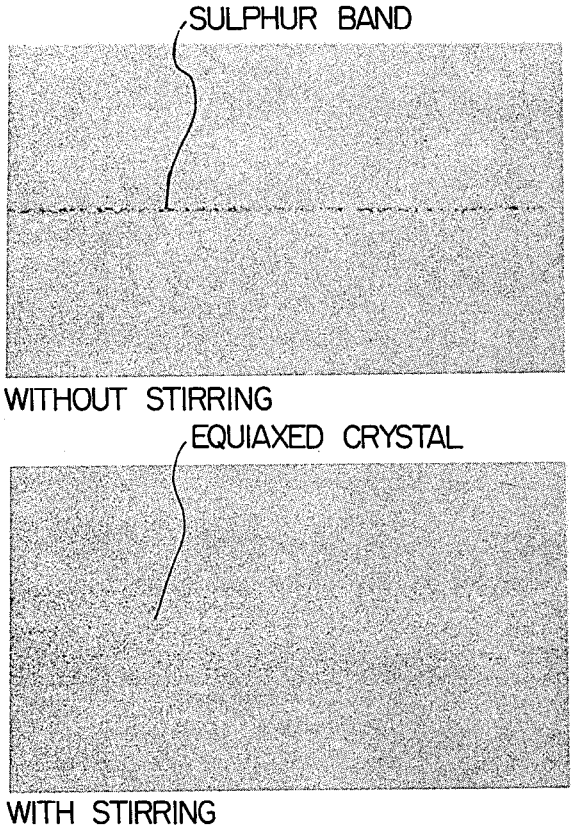
FIG. 34 is the enlargement of a part of the photograph shown in FIG. 33.

FIG. 34 is enlargements of a part of the photographs shown in FIG. 33.

The casting conditions used for producing the slabs shown in the photographs of FIGS. 33 and 34 are:

Size of the slabs: 200 mm thick × 2050 mm wide.

Compositions of the slab: C, 0.16% by weight; Si, 0.24; Mn, 0.71; P, 0.018; S, 0.012.

Rest being Fe and Incidental Impurities.

The molten steel of the above compositions was poured from the immersed nozzle of a tundish into a mold vibrated in the mode of a sine wave of a vertical-plus-bending type continuous casting apparatus (radius: 10.5m). The temperature of the molten steel in the tundish was 1542° C. The temperature on the liquidus line of the molten steel was 1520° C. The pouring temperature was 22° C higher, so that the speed of drawing the cast object was set at 0.75 m/min.

The molten steel was divided into two streams from the same tundish. One stream was supplied to a forming apparatus equipped with an electromagnetic agitator of the linear motor type, which was operated to reverse the flowing direction of molten steel every 5 seconds by means of a current supplied at 8 Hz. The other stream was supplied to a forming apparatus which was not so equipped. Other than the electromagnetic agitator, there was no difference between the two forming means. Electromagnetic agitation was carried out at the position where the crater was 70 mm thick. The length of the inertia flow zone was 700 mm. Therefore, the ratio between the length of the inertia flow and the thickness of the crater was 10. As shown in the photographs of FIGS. 33 and 34, where the specialized electromagnetic agitation was conducted in the range of the normal casting operation temperature (the temperature of the poured molten steel was 5° to 25° C higher than the temperature on the liquidus line of the molten steel), the cast object according to the present invention had an equiaxed structure formed symmetrically about the center thereof, even though it was cast by the continuous casting apparatus of the vertical-plus-bending type. As for the thickness of the equiaxed crystal portion, it was about one-third of the thickness of the cast slab, in the case of this embodiment. It is seen that, according to the present invention, equiaxed structure is formed for the first time on the upper surface of the slab cast by the continuous casting apparatus of the vertical-plus-bending type (upper side of the photograph). Also, according to the present invention, molten steel can be poured at a temperature 5° to 40° C higher than the temperature on the liquidus line of the molten steel, making it easier to control the pouring temperature, which constitutes a merit of the present invention.

In FIGS. 33 and 34, the photographs of the upper side show the cast objects made under conventional casting conditions without using electromagnetic agitation. The cast objects have, respectively, a sulfur band in the central part, dendrite structure nearly to the upper part of the slab, and an equiaxed crystal layer of only about one-sixth the thickness of the slab.

Figure 31:
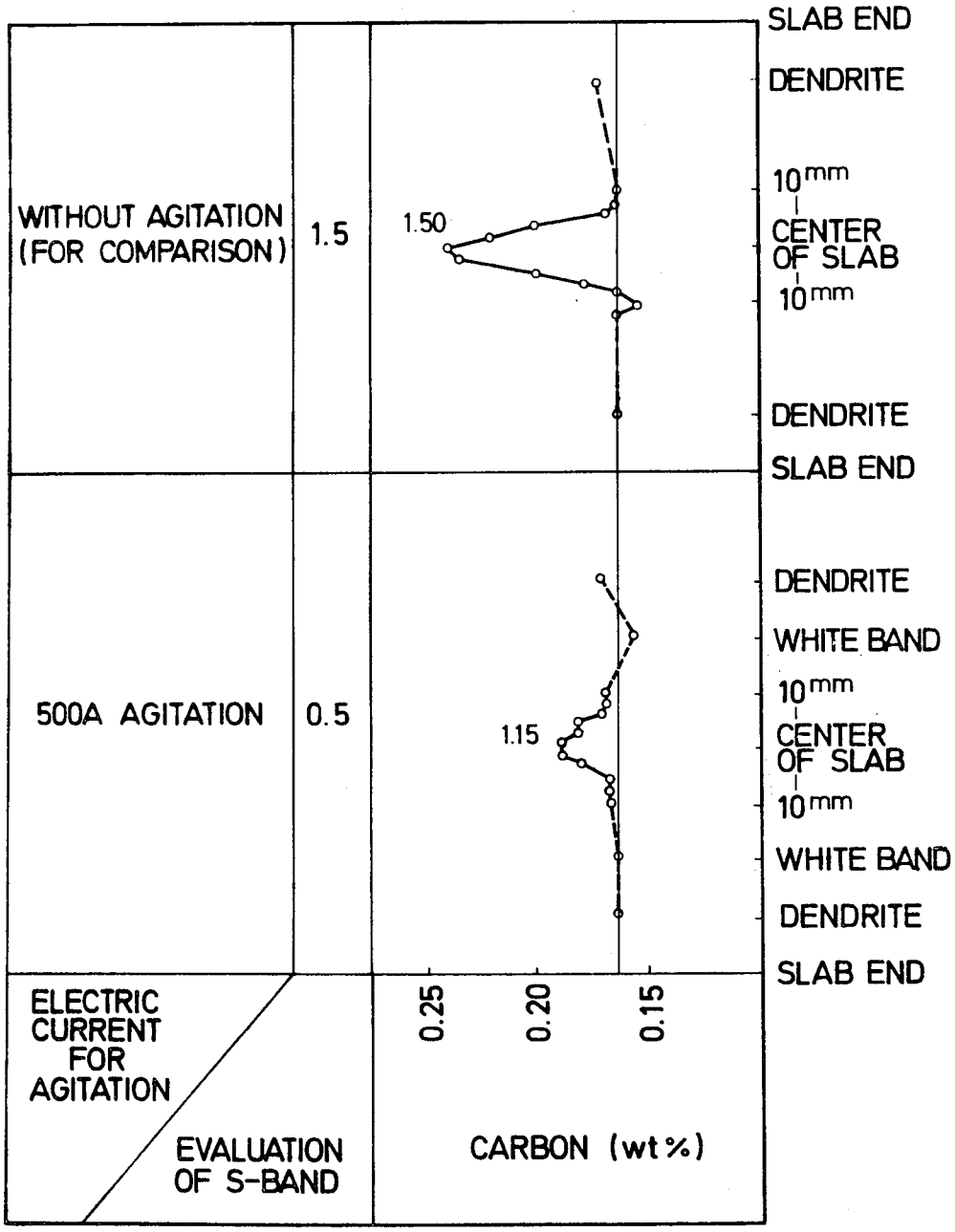
FIGS. 31 and 32 are, respectively, a graph showing the contents of carbon and sulfur and their distributions in respective steel slabs for comparison between a slab continuously cast by the method of the present invention and a slab made without electromagnetic agitation.
Figure 32:
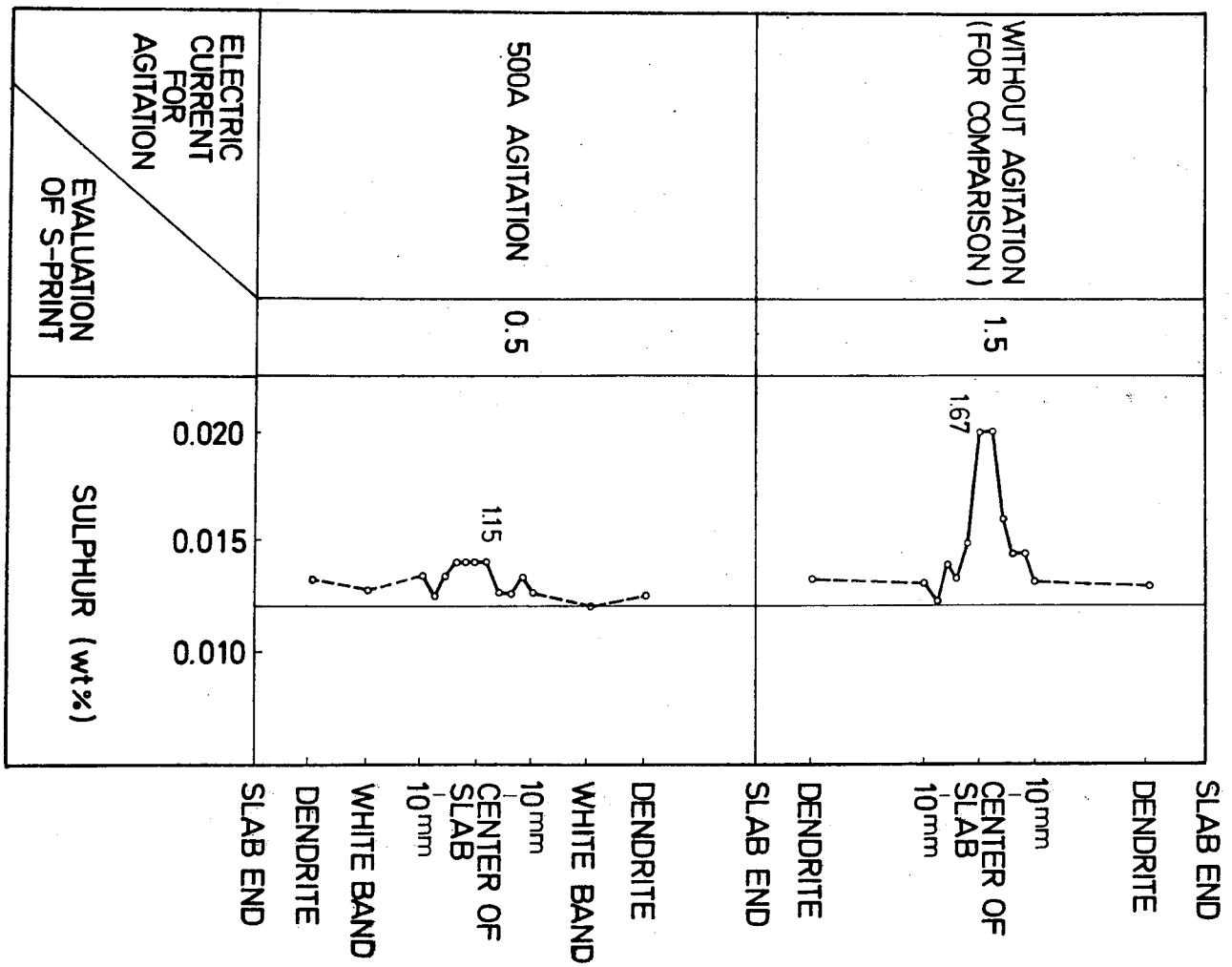

FIGS. 31 and 32 are graphs showing the degrees of segregation of carbon and sulfur in the thickness direction of the cast slabs, respectively, according to the present invention using electromagnetic agitation and by a casting method using no electromagnetic agitation, which slabs are shown in FIGS. 33 and 34.

From these graphs, it is also clear that the casting according to the present invention is effective.

The following is a detailed explanation of an electromagnetic induction agitator for the L-type continuous casting apparatus for continuously casting steel slabs, which carries out the method of the present invention.

The continuous casting apparatus 11, shown in FIG. 15, has a mold 14 below the nozzle 13 of a tundish 12. Molten steel is poured from a ladle 20 into the tundish 12, and then is poured into the mold 14 through the nozzle 13. In the mold 14, the part of molten steel in contact with the mold is cooled to solidify into a thin shell enclosing a slab 21 having a cross-section 960 to 2200 mm in width and 180 to 300 mm in thickness.

Below the mold 14 is a group of guide rolls 15, which have diameters varying according to the thickness of the solidified shell and static pressure of the molten steel for the prevention of swelling of the cast slab; that is, the diameter of pinch rolls near the mold 14 is smaller than that of pinch rolls away from the mold 14.

By means of such guide rolls 15, the cast slab 21 is withdrawn at a velocity between 0.5 and 1.7 m/min.

An electromagnetic induction apparatus 31 is positioned between the second segment 16 and the third segment 17 of the group of guide rolls 15 of said continuous casting apparatus 11. Said agitator 31 is at the point about 6 meters away from the bottom end of the tundish nozzle 13. At that position, a set of guide rolls (having a diameter of 250 to 300 mm) has been taken out and replaced by an exciter 32 of the agitator 31. As for rolls 18 and 19, respectively, ahead of the behind the exciter 32, they are made of a non-magnetic material, such as austenitic stainless steel. The use of such material is for the prevention of the weakening of the agitation force which might possibly be caused by the absorption of electromagnetic force produced by the exciter 32 into such parts, particularly guide rolls, if these were made of a magnetic material.

Figure 16:
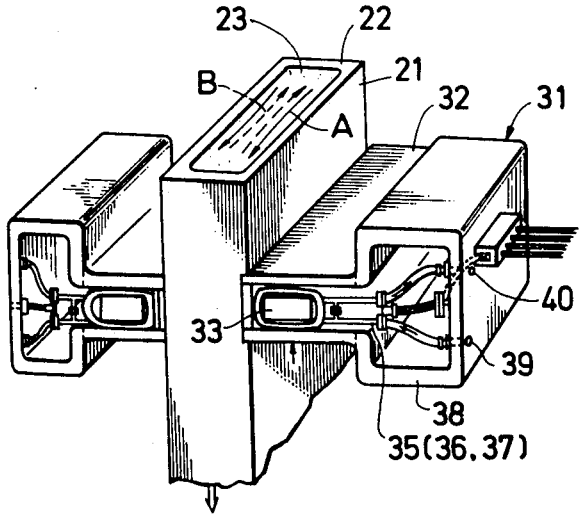
FIG. 16 is a perspective view of the main part of the agitator shown in FIG. 15.
Figure 17:
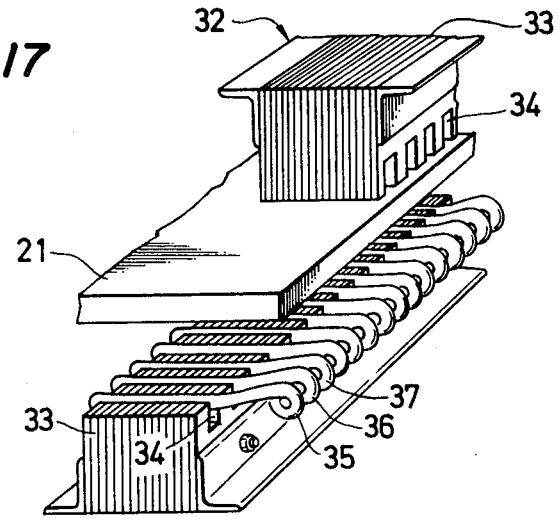
FIG. 17 is a perspective view of the exciting coils of the agitator shown in FIG. 16.

The electromagnetic induction agitator 31, shown in FIGS. 16 and 17, consists mainly of an exciter 32 and a power source. The exciter 32 is constructed with an iron core 33 having about 10 to 30 slots 34, coils 35, 36 and 37 set in these slots, and a housing made of a non-magnetic material enveloping the iron core 33 and the coils 35, 36 and 37.

Said exciter 31 has a pair of parts arranged to have a cast slab 21 interposed between them. The iron core 33 of said exciter 31 extends in the width direction of the cast slab 21. The coils 35, 36 and 37 are wound around the iron core 33 along the width direction of the slab 21. The gap between the surface of the cast slab 21 and that of the iron core 33 is about 3 to 5 mm to allow for heat due to contact of the slab 21 with the part around the iron core 33 and heat from magnetic resistance of the surface of the cast slab 21. Because the exciter 31 is allowed to move in the thickness direction of the cast slab 21, the gap is adjustable to allow for a change of thickness of the cast slab 21.

The coils 35, 36 and 37 are heated to a high temperature due to their own electric resistance and heat from the cast slab 21, raising coil resistance and degrading insulation. In order to prevent such troubles, the coils 35, 36 and 37 have a hollow space to permit the passage of water to cool them. In FIG. 16, numerals 39 and 40 indicate, respectively, an inlet and an outlet for cooling water for the coils.

The housing 38 has a part cooled with water for the prevention of over-heating of the coils 35, 36 and 37, and also for the prevention of deformation thereof.

Figure 18:
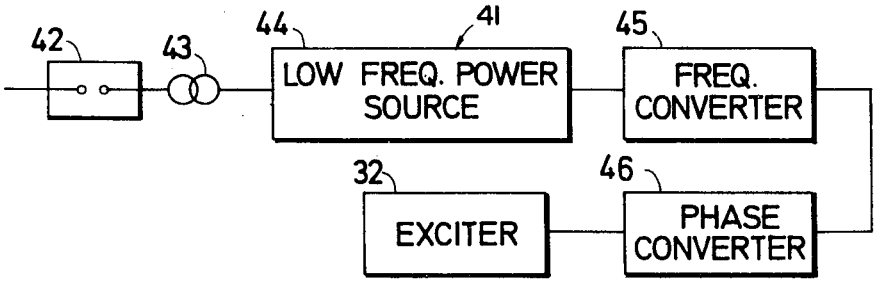
FIG. 18 is a block diagram of the power source for said agitator.

The following is a description of one embodiment of a power source 41 with reference to FIG. 18.

Input into the power source is a three-phase current at 3.3 KV and 50 Hz frequency. This is transmitted through a high voltage incoming panel 42 to a transformer 43, where it is reduced to 220 V. Then the current is transmitted to a low frequency power source 44, which consists of a three-phase thyristor converter or a mechanical converter using a synchronous motor of the like, and at which said alternating current is converted from 50 Hz to less than 20 Hz, more preferably 4 to 15 Hz. Output from said low frequency power source 44 is sent to a frequency converter 45 to be processed into the most preferred ferquency less than 20 Hz. Output from the frequency converter 45 is transmitted to the coils 35, 36 and 37 through an automatic phase converter 46.

The following is an explanation of the method for agitating the crater 23 of the cast slab 21 by using the electromagnetic agitator 31 which is constructed as mentioned above.

The slab 21 cast in the mold 14 is withdrawn downward by the group of guide rolls 15, and as it is withdrawn, it is cooled by water and air to solidify to form the solidified shell 22. When the slab 21 has reached the electromagnetic agitator 31, the solidified shell 23 has grown to a thickness of 40 to 60 mm, containing the crater 23 inside.

Figure 19:
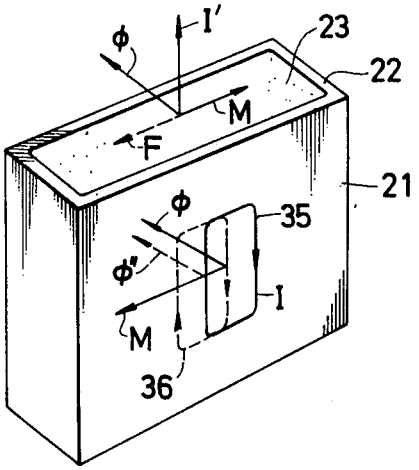
FIG. 19 is a perspective view of a part cut off from a continuous cast object so as to explain the flow in the crater of the cast object.

Under such conditions as described above, the cast slab 21 goes through the magnetic field produced by the coils 35, 36 and 37. As shown in FIG. 19, the coil 35 causes current I to produce magnetic flux $\phi$. Likewise, the coil 36 works to produce magnetic flux $\phi'$. As the exciting current I is three-phase alternating power, it moves in the direction of the arrow M from the magnetic flux $\phi$ to $\phi'$. This is equivalent to the molten steel 23 moving in the direction of the arrow M'. Therefore, induction current I' is produced in the molten steel 23. The thus produced induction current I' and the magnetic flux $\phi$ cause an electromagnetic force F of about 20 to 40 mm Hd to act in the molten steel.

In FIG. 16, the molten steel 23 flows in the direction of the arrow A under the effect of said electromagnetic force F. As described above, input into the coils 35, 36 and 37 is reversed at certain intervals. After reversal, the molten steel 23 flows reversely, i.e. in the direction of arrow B. Thus, the molten steel 23 in the crater of the cast slab is agitated by reversing the flow direction of the molten steel 23 at certain intervals.

In the above case of agitation, the exciting current used is of such a low frequency, i.e. 4 to 15 Hz, that it is possible to have an electromagnetic force of about 10 to 50 mm Hd penetrate into the molten steel 23 through the solidified shell 22, which may be as thick as 40 to 60 mm.

Because of such thickness of the solidified shell 22, the flow of the molten steel 23 does not cause breakout. The alternation of directions of the flow of the molten steel 23 enhances the effect of the agitation of the molten metal 23. As the direction of the flow of the molten steel is not fixed, dynamic pressure of the flow on the same part of the solidified shell 22 is avoided; thus, there is no danger of deformation of the cast slab 21.

As explained above, the electromagnetic agitation according to the present invention gives high permeability to the electromagnetic force, greatly raising the agitation efficiency. It operates at the position where the solidified shell of the cast slab has grown to such a thickness as to be strong enough to prevent breakout, and therefore there is no danger of such troubles with the cast slab.

The improvement of agitation efficiency is effective for the prevention of the segreation and of blow holes in the cast object.

Figure 20:
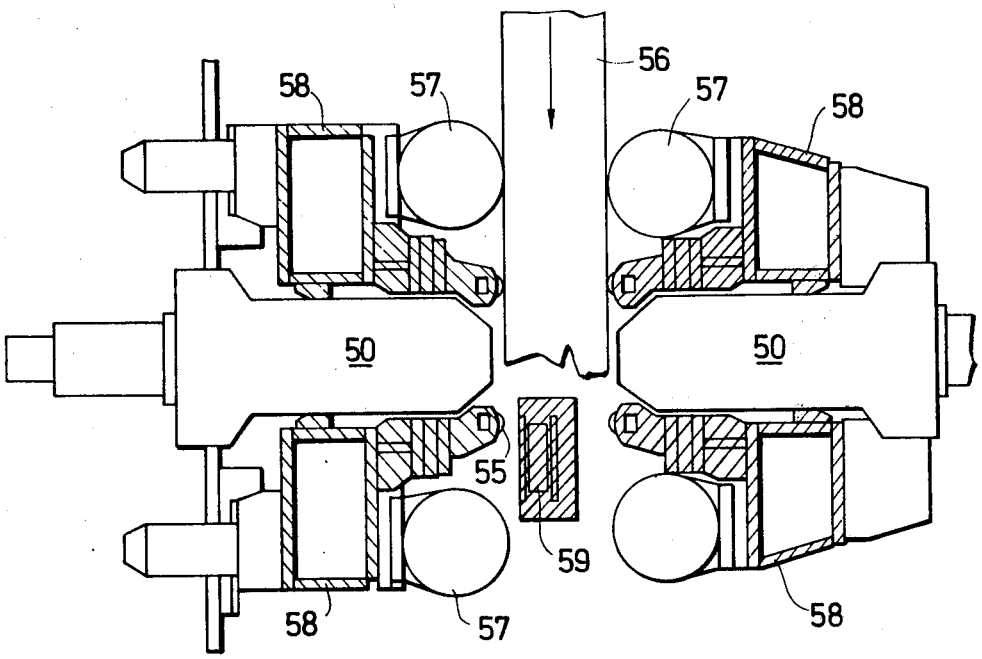
FIG. 20 is a side view of one embodiment of a part of the continuous casting apparatus of the present invention.

In FIG. 20 showing one embodiment of the electromagnetic agitator of the present invention, numberal 50 indicates the opposed electromagnetic agitator heads, each tapering, the withdrawing line being between them, and numeral 55 indicates small diameter rolls set closely above and below heads 50; numeral 56 indicates an object being cast continuously in the mold into the prescribed shape; numeral 57 indicates prearranged guide rolls. For the position at which the electromagnetic agitator is located on the continuous casting apparatus, refer to the foregoing description.

Figure 21:
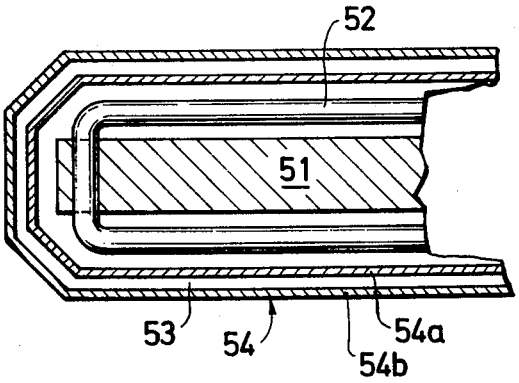
FIG. 21 is an enlarged view, partly broken, of one part of the main body of the electromagnetic agitator shown in FIG. 20.
Figure 22:
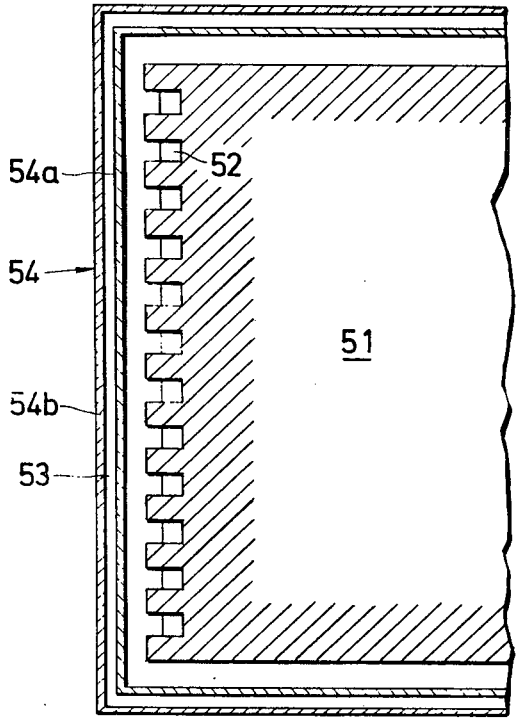
FIG. 22 is a partial sectional plan view of the main body of the electromagnetic agitator shown in FIG. 20.

As shown in FIGS. 21 and 22, said electromagnetic agitator 50 is constructed with a core 51 of the deep slot type having slots for winding coils, coils 52 wound around said core 51, and a housing 54 enclosing said core 51 and said coils 52 for protecting them. The reason for the deep slot type of the core 51, in which type the tip of the core 51 is close to the cast object 56 and the coils 52 wound around it are far away from the cast object 56, is that the coils 52 should be subjected as little as possible to the high temperature of the radiant heat from the cast object 56 for the protection of the coils, while the core 51 should be as closed as possible to the cast object 56, so as to provide a more effective agitation force thereto.

As for the core 51 of the deep slot type, it has a tip of a size to be accommodated between adjacent rolls, and also has a slot depth such that the tip thickness is not increased so as to touch the small diameter rolls 55 positioned above the below it when it has the coils wound thereon, the coils in the slots being outwardly, with respect to the casting, from the small diameter rolls. The housing 54 for the protection of said core 51 is double-walled, having an inner wall **54*a* and an outer wall 54*b*, the space between these walls constituting a passage 53; and the portion facing the cast object 56 is tapered at a sharp angle toward both sides complementary to the shape of the tip of the core 51 and the ends of the coils. The small diameter rolls 55 are positioned in the spaces left by this shape of the housing 54**.

As for the construction material of the housing 54, it must be a non-magnetic material, such as 18-8 stainless steel, in order to reduce electromagnetic agitation energy loss to a minimum. In addition, such other parts of the continuous casting apparatus according to the present invention as the group of guide rolls and segment members and the like for the support of the rolls, all in the vicinity of the agitator, for example the small diameter rolls 55, support frame 58 and side rolls 59 shown in FIG. 20, are preferably made of a non-magnetic material. Which parts should be so made depends on the capacity and size of the agitator, but it is considered sufficient in the present embodiment if all the members within about 300 mm from the surface of the agitator be so made, the parts within this range in FIG. 20 being hatched. The provision of the small diameter guide rolls 55 above and below the main body of the agitator 50 is to make the pitch for the points of support of the casting between guide rolls the same as or even smaller than in the conventional apparatus. This will make it possible not only to set the agitator closer to the cast object, but also to do so in the narrow space between the guide rolls 57, which is made by removing two guide rolls, thus ensuring smooth operation without great modification of the continuous casting apparatus, and also without danger of breakout. As for the small diameter rolls, their diameter is about ½ to ¼ of that of the guide rolls, which should be divided in the direction of their length into more than two parts, each to be supported independently of each other in preference to being integrated into one body.

Figure 26:
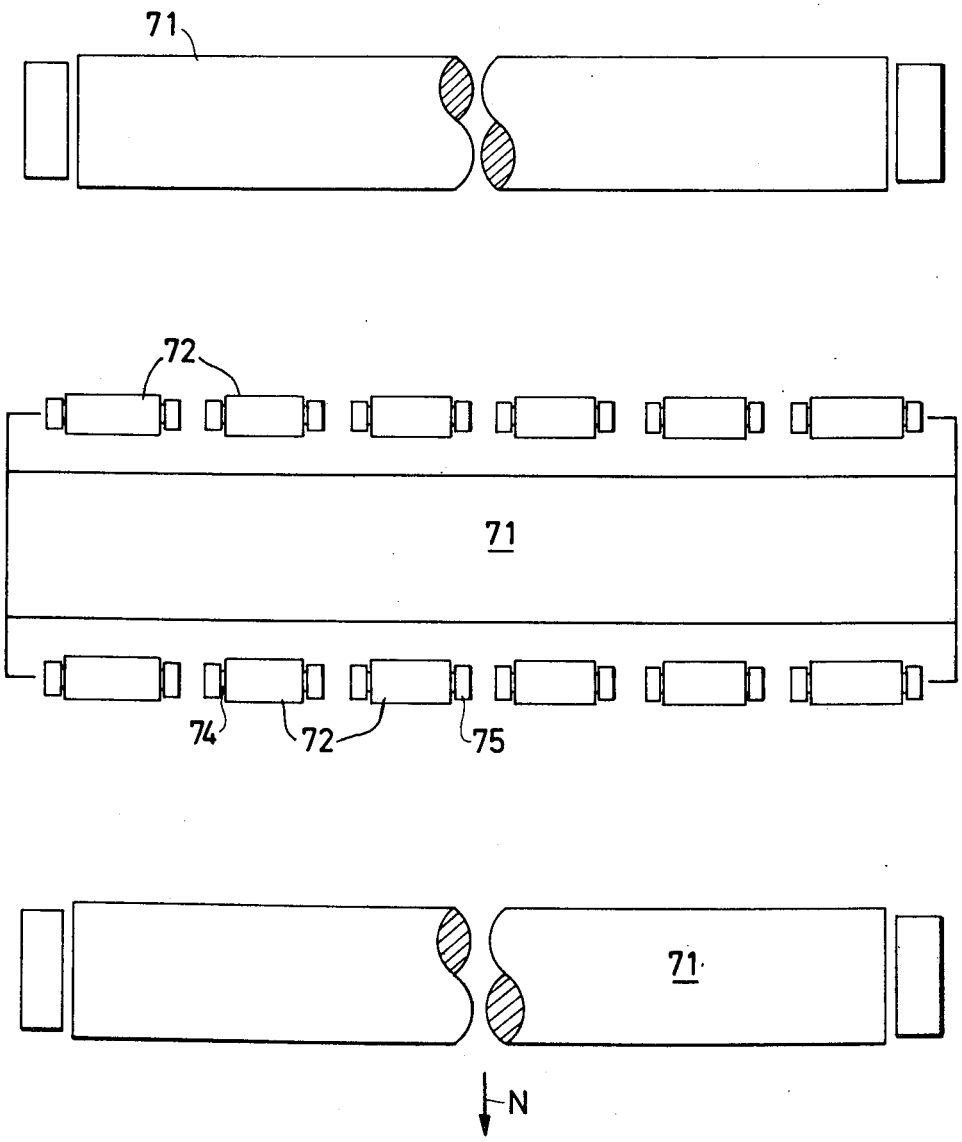
FIG. 26 is an explanatory view of one embodiment of the arrangement of the split rolls according to the present invention.

FIG. 26 shows an emboiment in which divided rolls of a small diameter are used together with conventional rolls of larger diameter. In the drawing, numberal 71 indicates guide rolls, which are not divided and are conventionally positioned in the continuous slab casting apparatus; numberal 72 indicates a plurality of guide rolls of small diameter, which are divided into portions, together having a length nearly corresponding to that of said guide roll 71, so as to support this roll 71. Each of the guide rolls 72 is supported independently from the other such rolls, so that it can be mounted or removed separately; but they are all mounted in a holding frame 75, as shown in the drawing.

The number of portions into which the guide roll of small diameter is divided is six in FIG. 26; but, according to the present invention, the number depends on the width of the cast object and the other conditions of the casting operation. The portions may be arranged not only in a straight line in the direction of the length of the casting, but also in such non-linear arrangements as a zig-zag. Also, according to the present invention, the guide rolls 72 are arranged in the direction across the direction of withdrawing the cast object (shown by the arrow N in FIG. 26). The arrangement in the direction across the direction of withdrawing the cast object means generally an arrangement of the guide rolls 72 in parallel with a direction perpendicular to the direction of withdrawing the cast object, or, as the case may be, an arrangement of such rolls on an angle to the direction of withdrawing the cast object. Furthermore, these guide rolls 72 can be provided in a great number together with the rolls of greater diameter 71 in the direction of withdrawing the cast object (in the case shown in FIG. 26); but, if necessary, all the cooling rollers, pinch rollers, guide rollers, straightener and the like may be replaced by split rolls 72.

The following is a detailed description of the construction of a single one of said guide rolls 72 of small diameter.

Figure 27:
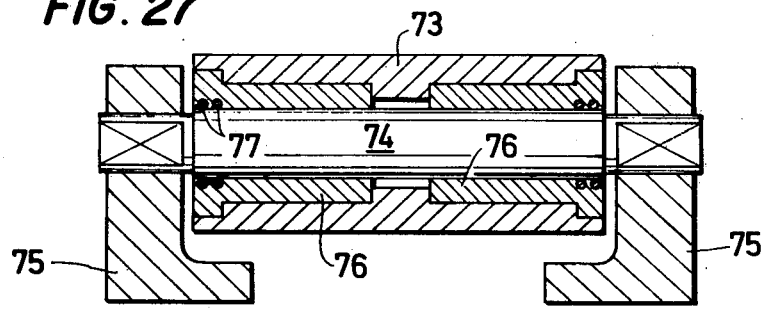
FIG. 27 is a cross-sectional view of one kind of the rolls used for the apparatus of the present invention.
Figure 28:
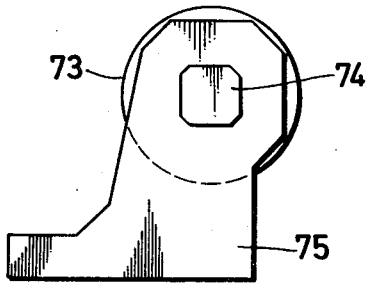
FIG. 28 is a side view of the roll of FIG. 27.

As shown in FIG. 27, the body of said roll is composed of a roll sleeve 73 and a roll shaft 74; a bearing 76 between the sleeve 73 and the shaft 74; and a plurality of sealing rings 77 between the shaft 74 and the bearing 76. As for the roll shaft 74, it is held fixedly by brackets 75 on both ends. The part of said bracket 75 and that of the shaft 74 which are for holding the shaft 74 are polygonal in shape, e.g. quadrangular, as shown in FIG. 28, for better load bearing characteristics. As for lubricant supply (not shown) for the divided rolls, supply through an independent pipe to each of the rolls is more convenient than the replacement of the rolls one at a time.

Generally, the diameter of the guide rolls 71 of the continuous slab casting apparatus is about 300 mm, but that of the rolls of smaller diameter 72 according to the present invention is less than 120 mm. As for the length of the roll shaft 74, it is less than 400 mm, if that of the roll sleeve 73 is less than 300 mm.

In order to prevent the generation of magnetic heat in the rolls near the electromagnetic agitator, the roll sleeve 73 of the roll shaft 74 of the brackets 75 for the guide rolls 72 are preferably made of stainless steel, a nonmagnetic material; the bearings 76 and the sealing rings 77 should preferably be made, respectively, of a material such as a high tension brass casting having graphite added as lubricant, and of heat-resisting nitrile rubber.

Because of the use of guide rolls 72 of small diameter having a construction as described above, the continuous casting apparatus of the present invention requires no more than the replacement by new rolls, if and when the rolls in use are worn out or out of order. Moreover, such replacement can be done without difficulty and at low cost. Besides, the diameter of the divided rolls is very much smaller than that of the rolls which have long been used for this type of continuous casting apparatus, so that the distance between points of support of the cast object (the distance between the adjacent rolls in the direction of withdrawing the cast object) can be made small, which is useful for a smooth casting operation and the prevention of breakout.

Even though they have a small diameter, these rolls have a comparatively short shaft, each being supported by a respective bearing independently, therefore providing a large supporting force and sufficient rolling pressure for the casting, resulting in an effective cast object withdrawing operation.

As described above, compared with the replacement of rolls of greater diameter as is the case with the conventional type of the continuous casting apparatus, a much easier replacing operation can be achieved with the apparatus of the present invention requiring only 1/6 to 1/10 of the time required for replacement of conventional rolls. Also, sufficient rolling pressure can be obtained only with the divided rolls according to the present invention.

Regarding the shape of the head of said housing 54, said head may be any shape such as projected or convex-surfaced, instead of being taper-shaped as shown in FIG. 21.

The following is an explanation of an embodiment of the apparatus of the present invention.

In order to maintain roll pitch at a necessary minimum for operation, and to reduce agitation energy loss to a minimum, it is necessary to position the core 51 itself as close as possible to the cast slab 56, so that the width of the core 51 in the direction of movement of the cast object should be as small as possible, say less then 100 mm.

The core 51 has the tip shaped like the teeth of a comb, and has in the long direction thereof concave slots for containing the coils 52. At the tip of the core 51, the depth of the slots is more than 100 mm, so that the distance between the tip of the core 51 and the end of the coils 52 in the slots is more than 50 mm.

The actual size of the housing 54 is less than 100 mm in thickness at the head, accommodating the thickness of the core 51, and the slope of the taper at each corner at the head being between 30° and 60° and less than 350mm thickness at the middle part of the body. Regarding the small diameter rolls 55, their diameter is less than 120mm (while that of the larger rolls is about 300mm).

The following is an explanation of the cooling process of the core and the coils.

Figure 23:
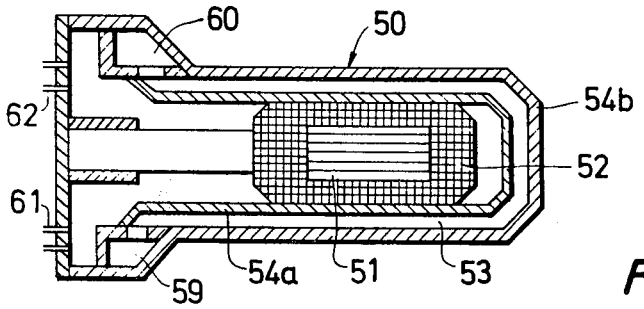
FIG. 23 is a cross-sectional view of the electromagnetic agitator shown in FIG. 20.

In FIG. 23, coolant runs from the coolant inlet 59 through said passage 53 to the coolant outlet 60, from which it is discharged out of the apparatus 50. Inside the shielding wall **54*a* there is compressed dry gas such as nitrogen or air, so as to cover the coils 52, the core 51, etc. with a dry atmosphere. Such gas is supplied from the gas inlet 61 in the rear part of the agitator 50, and after circulation it is discharged through the gas outlet 62**.

Where the shielding wall is a double wall having an inner wall **54*a* and an outer wall 54*b*, the joints in these walls should not be placed on the side toward the cast object 56; all the important parts such as the joints, the inlets and the outlets should be placed on the side opposite to the cast object 56**.

Figure 24:
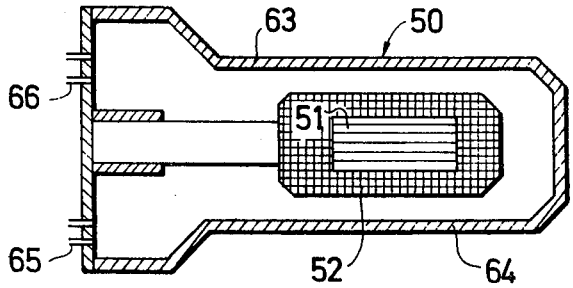
FIG. 24 is a cross-sectional view of another embodiment of the electromagnetic agitator.

While the housing is double-walled, having walls **54*a* and 54*b* in the above described embodiment, a housing such as is shown in FIG. 24 is satisfactory for the purpose of the present invention. In this structure, the coolant fills the housing 63 and directly contacts the core 51 and the coils. As coolant, such liquid as water is preferred which has a cooling efficiency. As the slab is at a high temperature, the coolant should preferably be a non-flammable liquid for the prevention of fire, in case of the leakage of same. For the prevention of overheating of the electromagnetic agitator 50 subjected for a long time to radiant heat from the cast object 56, the coolant should be at a temperature below a certain point. One way of achieving this is to cool the coolant outside the electromagnetic agitator 50 in a coolant circulation apparatus (not shown) before supplying it to the agitator 50 through the coolant inlet 65**.

In the above-described continuous casting apparatus of the present invention, it is possible for an electromagnetic agitator to be provided at a position at which it can work at its full capacity, without substantial remodeling of the apparatus, by using small diameter rolls and the special structure of the main body of the agitator. Moreover, the agitator itself has a high heat-resisting structure, and has small diameter rolls effective for keeping the pitch of the support points for the cast object (in the direction of withdrawing the cast object) small, which makes the casting operation smooth.

According to the present invention, the outer shell of the agitator and the members near the shell are made of a non-magnetic material, resulting in a high agitation efficiency so that more than 90% of the energy supplied is used for agitation, such rise of agitation efficiency making possible the reduction of the capacity and thus of the size. Beside, there is no danger of the members around the agitator being heated by leakage flux from the agitator.

Also, according to the present invention, the electromagnetic agitator has the outside enclosed by a coolant passage, and the inside contains dry gas. This construction results in high resistance of the main body of the electromagnetic agitator to radiant heat from the cast object having a high temperature, and avoids accidents due to water drops in the coils, and smooth introduction of coolant into the inside of the housing around the coils, this being effective for the extension of the life of the coils. Moreover, the head of the electromagnetic agitator can be kept very close to the surface of the casting, resulting in the reduction of electromagnetic agitation energy loss to a minimum and in such other effects as good quality of the cast object.

What is claimed is:

1. In a continuous casting apparatus having a mold, a device for withdrawing the cast object from the mold and a group of rolls along the path of the withdrawn cast object for supporting the cast object during withdrawal, the improvement comprising the combination of: a fixedly positioned non-rotatable electromagnetic agitator at a position along the path of the withdrawn cast object opposite the crater of molten metal within the cast object, said electromagnetic agitator having a core on opposite sides of the path of the cast object having a plurality of deep slots therein facing the cast object, coils wound around the cores at the bottoms of the deep slots, and a housing of non-magnetic material over the cores on opposite sides of the path of the cast object, said housing for the cores having a head over the portions of the cores between the slots, said housing protecting the core and the coils; and a plurality of roll sof non-magnetic material adjacent the magnetic agitator on opposite sides thereof in the direction of the path of the withdrawn cast object for supporting the cast object being withdrawn from the mold, said non-magnetic material rolls having a diameter from one-fourth to one-half that of the remainder of the rolls, and the pitch between the smaller diameter rolls being no greater than that between the larger rolls, said smaller diameter rolls being subdivided into at least two portions in the direction of their length.

2. The combination as claimed in claim 1 in which the head of the housing tapers toward the path of the cast object.

3. The combination as claimed in claim 1 in which said housing is a double walled housing having an outer wall and an inner wall spaced therefrom and having a space therebetween, said space being for circulation of a coolant.

4. The combination as claimed in claim 1 in which each of said coils has a space therewithin for circulation of a coolant.

* * * * *